US006707034B1

(12) United States Patent
Yamaguchi et al.

(10) Patent No.: US 6,707,034 B1
(45) Date of Patent: Mar. 16, 2004

(54) MASS SPECTROMETER AND ION DETECTOR USED THEREIN

(75) Inventors: Haruhisa Yamaguchi, Hamamatsu (JP); Makoto Nakamura, Hamamatsu (JP); Takehisa Okamoto, Hamamatsu (JP); Hiroshi Suzuki, Hamamatsu (JP); Takayuki Ohmura, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 46 days.

(21) Appl. No.: 10/230,349

(22) Filed: Aug. 29, 2002

(51) Int. Cl.[7] ..... H01J 49/26
(52) U.S. Cl. ..... 250/283; 250/281
(58) Field of Search ..... 250/281, 397, 250/251, 287, 309

(56) References Cited

U.S. PATENT DOCUMENTS

| | | | | | |
|---|---|---|---|---|---|
| 4,996,422 | A | * | 2/1991 | Mitsui et al. | 250/281 |
| 5,387,797 | A | * | 2/1995 | Bauco et al. | 250/397 |
| 5,756,993 | A | * | 5/1998 | Yoshinari et al. | 250/281 |
| 5,866,901 | A | | 2/1999 | Penn et al. | |
| 6,091,068 | A | * | 7/2000 | Parfitt et al. | 250/292 |
| 6,239,549 | B1 | * | 5/2001 | Laprade | 313/533 |

FOREIGN PATENT DOCUMENTS

| | | |
|---|---|---|
| JP | B2 60-36060 | 8/1985 |
| JP | A 2001-351564 | 12/2001 |

* cited by examiner

*Primary Examiner*—John R. Lee
*Assistant Examiner*—Johnnie Smith
(74) *Attorney, Agent, or Firm*—Oliff & Berridge, PLC

(57) ABSTRACT

An ion detector includes an ion input face, a Faraday cup, an ion-to-electron converter dynode, two ion deflection electrodes, an electron multiplier portion, and an anode. The ion input face is formed with an ion input opening. The Faraday cup has an ion collection surface that confronts the ion input opening. The ion-to-electron converter dynode is disposed to one side with respect to the Faraday cup and the ion input opening and has a conversion surface that converts impinging ions into electrons. The two ion deflection electrodes generate an electron lens that attracts and focuses ions from the ion input opening toward the conversion surface of the ion-to-electron converter dynode. The electron multiplier portion receives and multiplies the electrons from the ion-to-electron converter dynode, and includes a plurality of dynodes that multiply electrons one after the other. The plurality of dynodes are juxtaposed in an arc-shape around the Faraday cup. The anode receives electrons from the electron multiplier portion and outputs a signal that corresponds to the amount of input ions.

14 Claims, 7 Drawing Sheets

MASS SPECTROMETER AND ION DETECTOR USED THEREIN

BACKGROUND OF THE INVENTION

1. Field of the Invention

The present invention relates to a mass spectrometer and an ion detector used therein.

2. Description of the Related Art

U.S. Pat. No. 6,091,068 discloses an ion detector that includes a Faraday cup and a tube-shaped continuous-dynode electron multiplier. (Details of a tube-shaped continuous-dynode electron multiplier are disclosed in U.S. Pat. No. 5,866,901.) In a Faraday cup mode of operation, the Faraday cup is connected to the input of an electrometer. The incoming ion beam formed from positively charged ions impinges on the collector plate of the Faraday cup. The ions are neutralized upon striking the collector plate, drawing a current as a signal output to the electrometer.

The continuous-dynode electron multiplier in U.S. Pat. No. 6,091,068 includes a conical entrance opening. A grid shield is positioned adjacent to the conical entrance opening. During an electron multiplier mode of the ion detector, a high electrical potential is established at the grid shield so that incoming ions are drawn into the. conical entrance opening. At this time, readings are taken from the output of the continuous-dynode electron multiplier.

SUMMARY OF THE INVENTION

Continuous-dynode electron multipliers cannot be used with a heavy current, so have a limited dynamic range of 0.1 FA to 100 nA. As shown in FIG. 1, Faraday cups have a dynamic range of only about 1 mA to 1 $\mu$A. Therefore, there is a range Y where the ion detector of U.S. Pat. No. 6,091,068 cannot take accurate readings.

Also, continuous-dynode electron multipliers only have a small secondary electron emissive surface for multiplying electrons. The surface area of the secondary electron emissive surface is limited by the inner surface of the channel running through the tube. The channel is an approximately 1 mm diameter hole, so the electron density per unit surface area is great. Therefore, a large burden is placed on the secondary electron emissive surface in the channel so that the continuous-dynode electron multiplier has a short life.

It is an objective of the present invention to overcome the above-described problems and provide an ion detector with a broad dynamic range and with a long use life.

In order to achieve the above-described objectives, an ion detector according to the present invention includes an ion input face, a Faraday cup, an ion-to-electron converter dynode, two ion deflection electrodes, an electron multiplier portion, and an anode. The ion input face is formed with an ion input opening. The Faraday cup has an ion collection surface that confronts the ion input opening. The ion-to-electron converter dynode is disposed to one side with respect to the Faraday cup and the ion input opening and has a conversion surface that converts impinging ions into electrons. The two ion deflection electrodes generate an electron lens that attracts and focuses ions from the ion input opening toward the conversion surface of the ion-to-electron converter dynode. The electron multiplier portion receives and multiplies the electrons from the ion-to-electron converter dynode, and includes a plurality of dynodes that multiply electrons one after the other. The plurality of dynodes are juxtaposed in an arc-shape around the Faraday cup. The anode receives electrons from the electron multiplier portion and outputs a signal that corresponds to the amount of input ions.

A mass spectrometer according to the present invention includes the above-described ion detector, an ionization portion, and a mass separator. The ionization portion converts molecules of a sample into ions. The mass separator separates desired ions from other ions from the ionization portion. The ion input face confronts the mass separator and the ion collection surface of the Faraday cup confronts the mass separator through the ion input opening.

According to another aspect of the present invention an ion detector includes an ion input face, a Faraday cup, an ion-to-electron converter dynode, an ion deflection electrode, an electron multiplier portion, and an anode. The ion input face is formed with an ion input opening. The Faraday cup has an ion collection surface that confronts the ion input opening. The Faraday cup is connected to ground. The ion-to-electron converter dynode is disposed to one side with respect to the Faraday cup and the ion input opening. The ion-to-electron converter dynode is applied with a high voltage and has a conversion surface that converts impinging ions into electrons. The ion deflection electrode generates, with the Faraday cup and the ion-to-electron converter dynode, an electron lens that attracts and focuses ions from the ion input opening toward the conversion surface of the is ion-to-electron converter dynode. The electron multiplier portion receives and multiplies the electrons from the ion-to-electron converter dynode. The electron multiplier portion includes a plurality of dynodes that multiply electrons one after the other. The plurality of dynodes are juxtaposed in an arc-shape around the Faraday cup. The anode receives electrons from the electron multiplier portion and outputs a signal that corresponds to the amount of input ions.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENT

Figure 1:
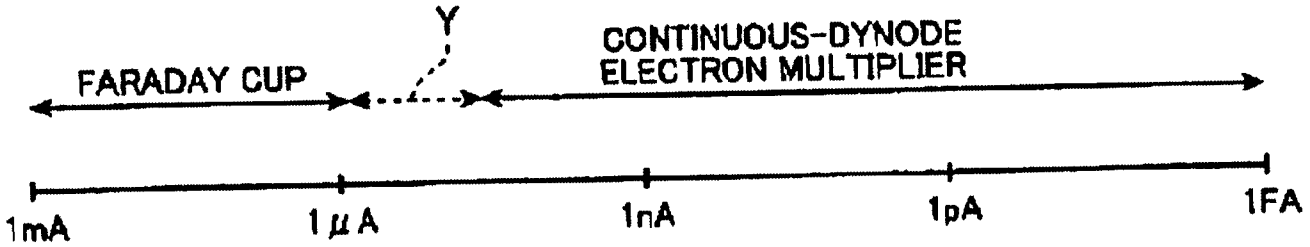
FIG. 1 is a chart showing dynamic ranges of a Faraday cup and a continuous-dynode electron multiplier of a conventional ion detector.
Figure 2:
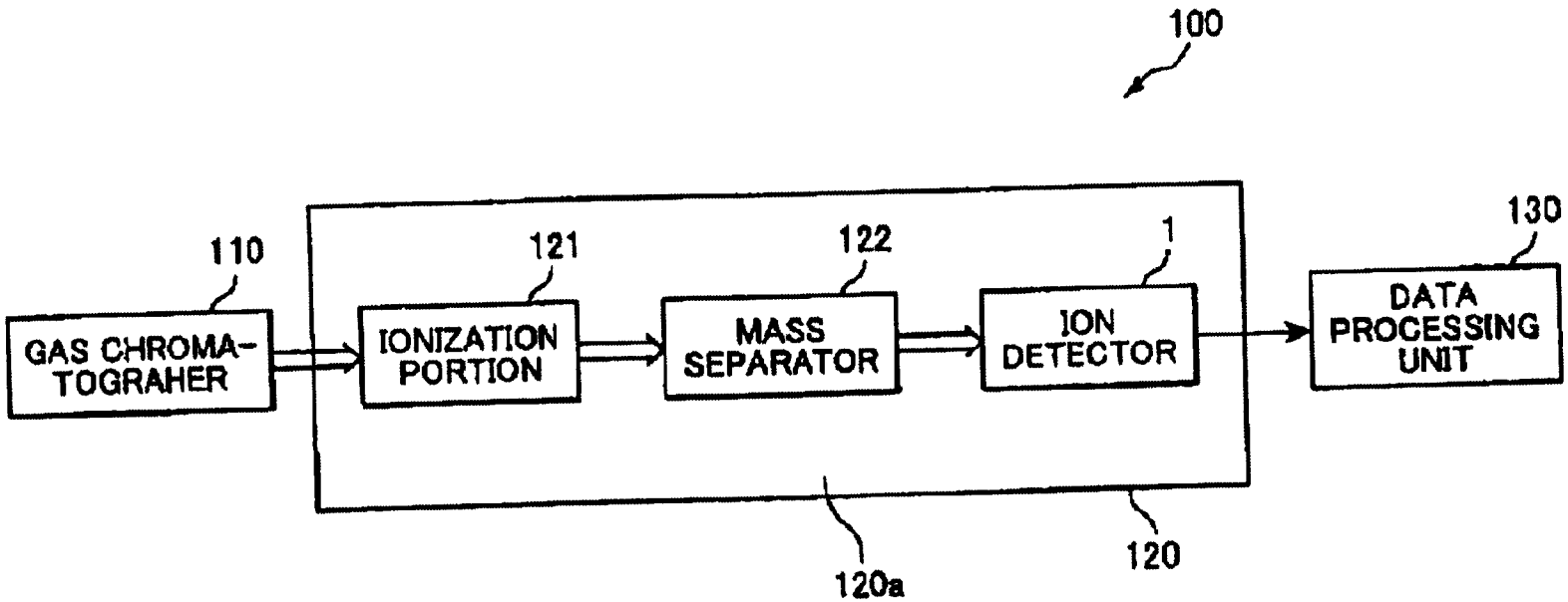
FIG. 2 is a block diagram showing components of a mass spectrometer according to an embodiment of the present invention.
Figure 3:
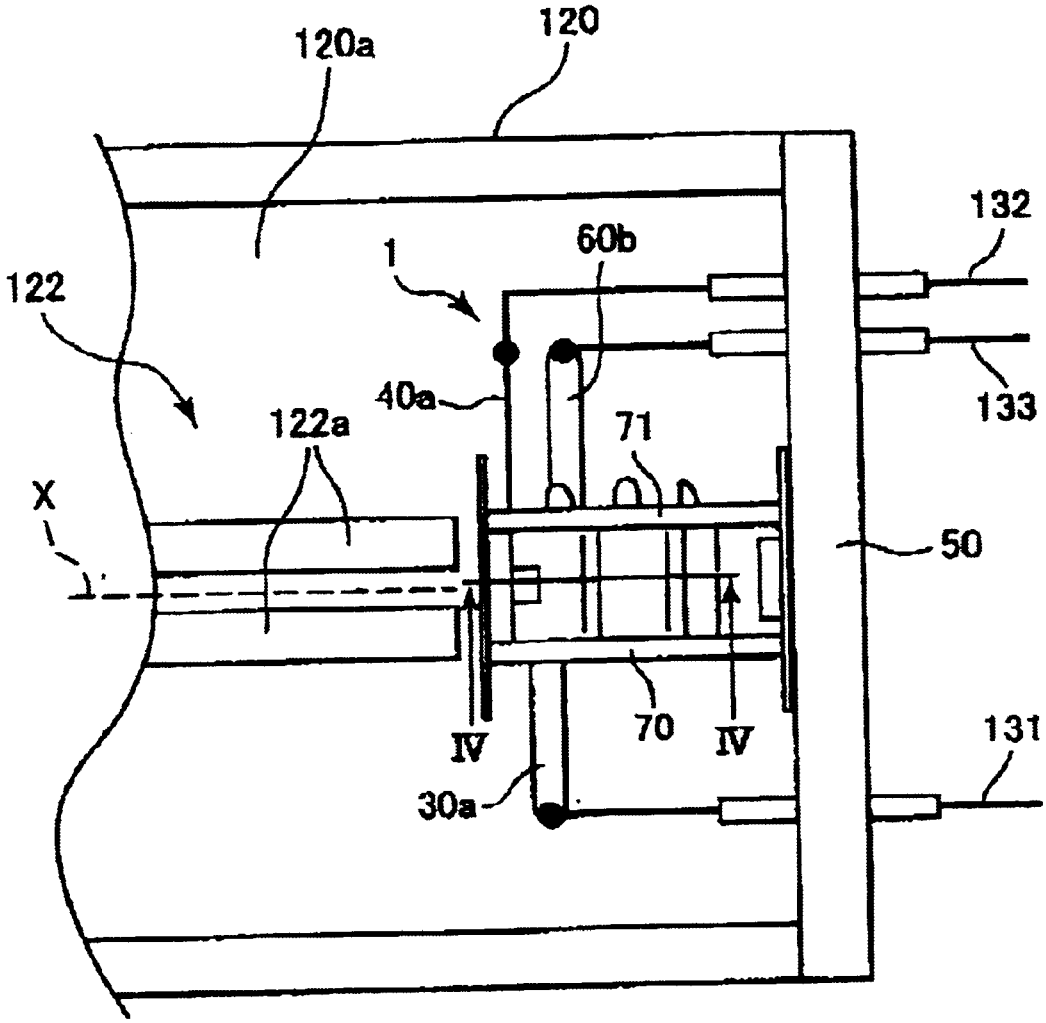
FIG. 3 is a side view showing a mass separator and an ion detector of the mass spectrometer.

Next, a mass spectrometer 100 including an ion detector 1 according to an embodiment of the present invention will be described. As shown in FIG. 2, the mass spectrometer 100 includes a gas chromatographer 110, a stainless steel envelope 120, and a data processing unit 130. The gas chromatographer 110 includes a sampler injection port (not shown) through which liquid samples are injected The envelope 120 houses an ionization portion 121, a mass separator 122, and the ion detector 1 within a vacuum chamber 120*a*. The ionization portion 121 includes a filament (not shown) for generating heat that converts molecules in the sample into positive or negative polarity ions. As shown in FIG. 3, the mass separator 122 includes cylindrical quadruple (Q-) pole electrodes 122*a* that are arranged in parallel around an imaginary axis X and that are electrically connected to the data processing unit 130. Four Q-pole electrodes 122*a* are provided, although only two are shown in the drawings.

Returning to FIG. 2, the data processing unit 130 controls application of voltage to the filament of the ionization portion 121 and to the Q-pole electrodes 122*a* and also to a single high-voltage connector 40*a* of the ion detector 1 as will be described later. The data processing unit 130 further receives and analyses electric signals from the ion detector 1 to determine various information about the liquid sample injected into the gas chromatographer 110.

As shown in FIG. 3, the ion detector 1 includes two confronting ceramic walls 70, 71, an electron multiplier portion 50, a Faraday cup connector 30*a*, the high-voltage connector 40*a*, and an anode connector 60*b*. As will be described later, the ceramic walls 70, 71 support the electron multiplier portion 50 therebetween. The Faraday cup connector 30*a*, the high-voltage connector 40*a*, and the anode connector 60*b* are connected to the data processing unit 130 through pins 131, 132, 133, respectively.

Figure 4:
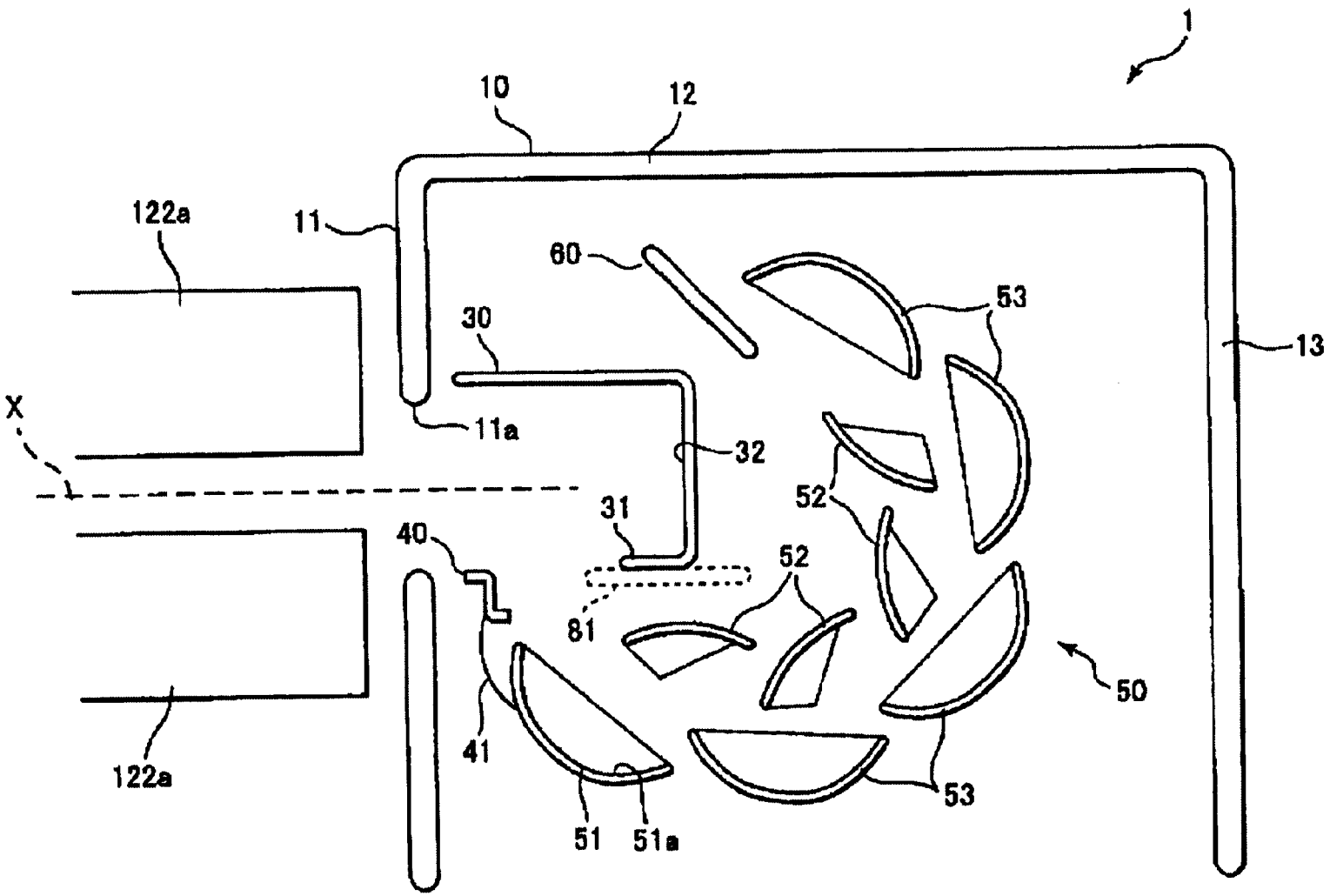
FIG. 4 is a cross-sectional view taken along line IV—IV of FIG. 3.

Referring to FIG. 4, the ion detector 1 further includes a stainless steel shield 10, a Faraday cup 30, a deflection electrode 40, and an anode 60. The shield 10 is formed from a single sheet of stainless steel bent into a substantial C-shape and includes an input face 11, a rear support 12, and a base 13. The shield 10 is connected to ground. The input face 11 is formed with an ion input opening 1*a* that is aligned on the imaginary axis X. The shield 10, in particular the rear support 12, is located at a position closer to the anode 60 than to the Faraday cup 30, the ion deflection electrode 40, and an ion-to-electron converter dynode 51 of the electron multiplier portion 50. It should be noted that as shown in FIG. 4, no stainless shield is provided at the side nearest the ion-to-electron converter dynode 51.

The Faraday cup 30 is disposed adjacent to and in confrontation with the input opening 11*a*. The Faraday cup 30 includes an integral ion deflector portion 31 and an ion collection surface 32, both of which are constantly connected to ground through the Faraday cup connector 30*a* and the data processing unit 130, and so are maintained at a constant voltage of 0 V. The ion collection surface 32 is aligned on the imaginary axis X so as to confront the ion input opening 11*a* and mass separator 122 through the ion input opening 11*a*. The ion deflector portion 31 extends from the ion collection surface 32 in the general direction of the ion input opening 11*a* and the ion deflection electrode 40.

The ion deflection electrode 40 is disposed to one side of the imaginary axis X at a location between a non-open portion of the input face 11 and the Faraday cup 30. The ion deflection electrode 40 is bent in a substantial Z shape so that one end of the electrode is closer to the opening 11*a*. The ion deflection electrode 40 is electrically connected to the high-voltage connector 40*a*.

The electron multiplier portion 50 includes the ion-to-electron converter dynode 51, inner dynodes 52, and outer dynodes 53. The ion-to-electron converter dynode 51 is disposed to one side of the Faraday cup 30 and the ion deflection electrode 40 with respect to the imaginary axis X. The ion-to-electron conversion dynode 51 includes a conversion surface 51*a* and is electrically connected to the ion deflection electrode 40 by a line 41. The inner dynodes 52 and the outer dynodes 53 are juxtaposed in an arc-shape around the Faraday cup 30. Each of the inner dynodes 52 and the outer dynodes 53 has a secondary electron emissive surface aligned to receive and multiply electrons from the preceding dynode of the electron multiplier portion 50, starting with electrons generated by the ion-to-electron converter dynode 51. The outer dynodes 53 are juxtaposed on an imaginary arc farther from the Faraday cup 30 than the inner dynodes 52 and each has a larger secondary electron emissive surface than do each of the inner dynodes 53.

The anode 60 is disposed in confrontation with the secondary electron emissive surface of the last dynode 53 of the electron multiplier portion 50 and is electrically connected to the data processing unit 130 through the anode connector 60*b*.

Figure 5:
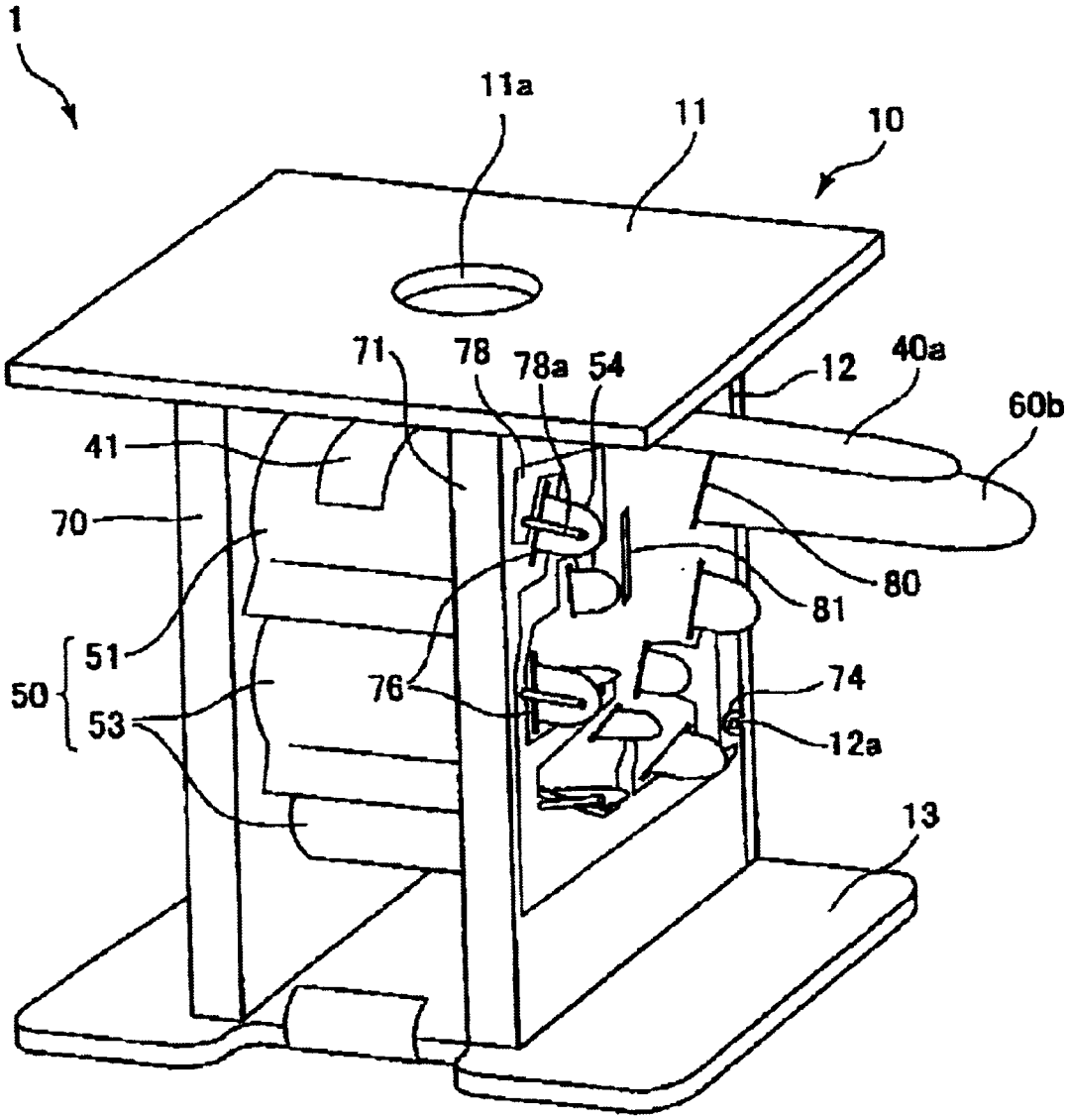
FIG. 5 is a perspective view showing external configuration of the ion detector.

External configuration of the ion detector 1 is shown in more detail in FIG. 5. The ceramic walls 70, 71 are each formed with two holes 74 (only one hole 74 of the wall 71 is shown in FIG. 5). The rear support 12 of the shield 10 has four crimped sections 12*a* (only one is shown in FIG. 4), which are bent into corresponding holes 74 in the ceramic walls 70, 71 to support the ceramic walls 70, 71 in place.

The ceramic walls 70, 71 are further formed with a plurality of slits 76, 80, 81, which are elongated through hole passing completely through the ceramic walls 70, 71. Plural slits 76 are formed at positions corresponding to positions of the dynodes 51, 52, 53. Connection terminals 54 of the dynodes 51, 52, 53 protrude through the slits 76. A circuit pattern 78 is formed on the ceramic wall 71. The circuit pattern 78 is electrically connected to the high-voltage connection 40*a* and includes resistance for determining voltage that is applied to the dynodes 51, 52, 53 through connection terminals 54 of the dynodes 51, 52, 53. Because the circuit pattern 78 is formed on the surface of the insulating substrate wall 71, the ion detector 1 overall can be made more compact. The connection terminals 54 are electrically connected to the circuit pattern 78 at their outermost tips through the tips of wires 78*a*. The ceramic walls 70, 71 are formed with three slits 80 (only one is shown in FIG. 5): two in the ceramic wall 71 and one in the ceramic wall 70. The high-voltage connector 40*a*, the anode connector 60*b*, and the Faraday cup connector 30*a* protrude through the slits 80. The slit 81 is formed completely through the ceramic wall 71 at a position between the Faraday cup 30 and the first one of the inner dynodes 52 as shown in dotted line in FIG. 4.

Next, operation of the mass spectrometer 100 will be described. First, the power of the mass spectrometer 100 is turned ON. Then, the operator of the mass spectrometer 100 injects a liquid sample into the sampler injection port of the gas chromatographer 110. The ionization portion 121 converts molecules in the sample into positive or negative polarity ions (positive in this example). At this time, the data processing unit 130 generates a voltage by superimposing a constant voltage and an AC voltage with a predetermined frequency and applies the voltage to the Q-pole electrodes 122*a*. Of the ions generated by the ionization portion 121, only ions with a mass that corresponds to the predetermined frequency are guided through the Q-pole electrodes 122*a* to the ion input opening 11*a* of the ion detector 1 and so are separated from the ions with other mass.

The ion detector 1 converts the amount of ions from the mass separator 122 into an electric signal using the electron multiplier portion 50 or the Faraday cup 30, depending on the mode of the mass spectrometer 100. Initially the mass spectrometer 100 is in its electron multiplier mode at the start of operations.

Figure 6:
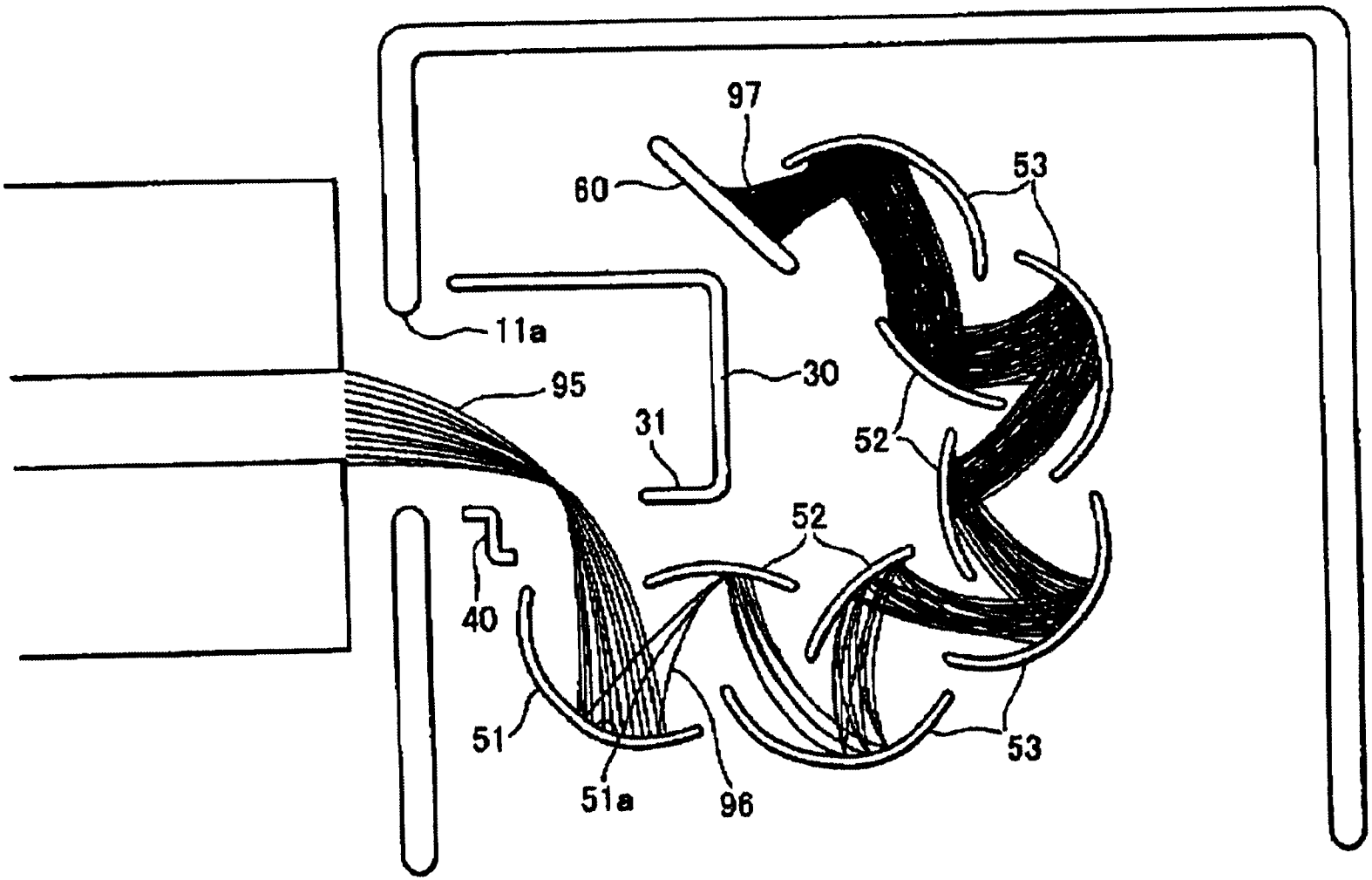
FIG. 6 is a schematic view showing operation of an electron multiplier portion of the ion detector.

During the electron multiplier mode, the data processing unit 130 applies a high voltage of −1,000 V to the high-voltage connection 40*a*. Because the high-voltage connection 40*a* is electrically connected to the ion deflection electrode 40 and, through the connecting line 41, to the ion-to-electron conversion dynode 51, a voltage of 1,000 V is developed at the ion deflection electrode 40 and to the ion-to-electron conversion dynode 51. As a result, an electric field develops between the Faraday cup 30 (particularly the electrode wall 31 thereof), the ion deflection electrode 40, and the ion-to-electrode converter dynode 51. The electric field functions as an electron lens to, as shown in FIG. 6, draw ions 95 that pass from the mass separator 122 through the ion input opening 11*a*, through a single focal point and toward the conversion surface 51*a* of the ion-to-electron converter dynode 51. The shapes of, the positions of, and voltages applied to the Faraday cup 30, the ion deflection electrode 40, and the electron multiplier portion 50 determine the effects of the electron lens. For example, because the ion deflection electrode 40 is bent in a substantial Z shape and one end is closer to the opening 11*a*, ions are more strongly pulled toward the ion-to-electron converter dynode 51.

It should be noted that at this time an electric short-circuit between the high-voltage ion-to-electron converter dynode 51 and the shield 10 is prevented because the shield 10, in particular the rear support 12, is located at a position closer to the anode 60 than to the Faraday cup 30, the ion deflection electrode 40, and the ion-to-electron converter dynode 51 of the electron multiplier portion 50.

The ion-to-electron conversion dynode 51 converts ions that impinge on the conversion surface 51*a* into electrons. The circuit pattern 78 is also applied with the 1,000 V voltage from the high-voltage connection 40*a*. The resistance of the circuit pattern 78 on the ceramic wall 71 regulates voltage developed at the other dynodes 52, 53. For example, a −900 V voltage is developed at the first inner dynode 52. It should be noted that at this time, the slit 81 prevents an electric discharge from occurring by current flowing across the surface of the ceramic wall 70 from the first of the inner dynodes 52 (−900 volts) to the Faraday cup 30 (ground). Such a discharge would be undesirable because the light generated by the discharge could be picked up by the electron multiplier portion 50.

The electrons from the ion-to-electrode conversion dynode 51 are deflected toward the secondary emission surface of the first inner dynode 52. The other dynodes 52, 53 multiply the electrons one after the other as shown in FIG. 6 until the multiplied electrons 97 reach the anode 60. The anode 60 receives electrons from the electron multiplier portion 50 and outputs a signal to the data processing unit 130 through the anode connector 60*b*. The signal corresponds to the amount of ions input through the ion input opening 11*a*. During this time, the Faraday cup 30 physically blocks light (photons) from entering the electron multiplier portion 50 from the direction of the ion emission source. Such light can be a source of undesirable noise. Also, the electron multiplier portion 50 is electrically shielded by the shield 10.

The data processing unit 130 monitors the signal from the anode connector 60*b* and determines whether the signal exceeds a predetermined threshold. The data processing unit 130 maintains the electron multiplier mode as long as the signal is equal to or less than the predetermined threshold. However, if the data processing unit 130 judges that the amount of ions output from the anode 60 exceeds the predetermined threshold, then the data processing unit 130 switches to the Faraday cup mode. In the present embodiment, the threshold is 10 $\mu$A or greater.

During the Faraday cup mode, the data processing unit 130 stops application of voltage to the high-voltage connection 40*a* and connects the high-voltage connection 40*a* to ground. As a result, ions input from the mass separator 122 through the ion input opening 11*a* impinge on the ion collection surface 32. Each time an ion from the mass separator 122 impinges on the ion collection surface 32, an electron travels through the Faraday cup connector 30*a*, either to or from ground depending on the polarity of the ion. The data processing unit 130 reads the resultant electric signal on the Faraday cup connector 30*a* to determine ion amount.

Figure 7:
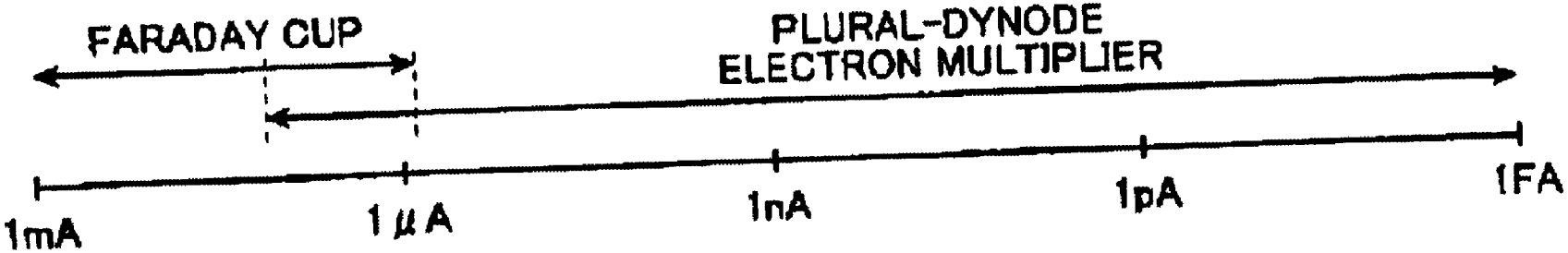
FIG. 7 is a chart showing dynamic ranges of the electron multiplier portion and a Faraday cup of the ion detector of FIG. 4.

Because the electron multiplier portion 50 includes a plurality of dynodes 51, 52, 53, it can be applied with a heavy current compared with continuous-dynode electron multipliers. Therefore, the ion detector of the present invention has a broader dynamic range. As shown in FIG. 7, the dynamic range of the Faraday cup 30 and the electron multiplier portion 50 properly overlap, so that readings are accurate over an overall broader range. Further, because the electron multiplier portion 50 has a larger secondary electron emissive surface than do continuous-dynode electron multipliers, the electron multiplier portion 50, and consequently the ion detector 1, has a comparatively long life.

Because the Faraday cup 30 (particularly the electrode wall 31 thereof), the ion deflection electrode 40, and the ion-to-electrode converter dynode 51 generate an electron lens, ions 95 that pass from the mass separator 122 through the ion input opening 11*a*can be reliably drawn through a single focal point and toward the conversion surface 51*a* of the ion-to-electron converter, dynode 51. Because the ion deflector portion 31 is used as one of the electrodes to form the electron lens, the ion detector 1 is easier to produce, and can be made more compact, than if a separate electrode were provided. Further, the ion deflector portion 31 enhances the function of the Faraday cup 30 of blocking ions.

Figure 8:
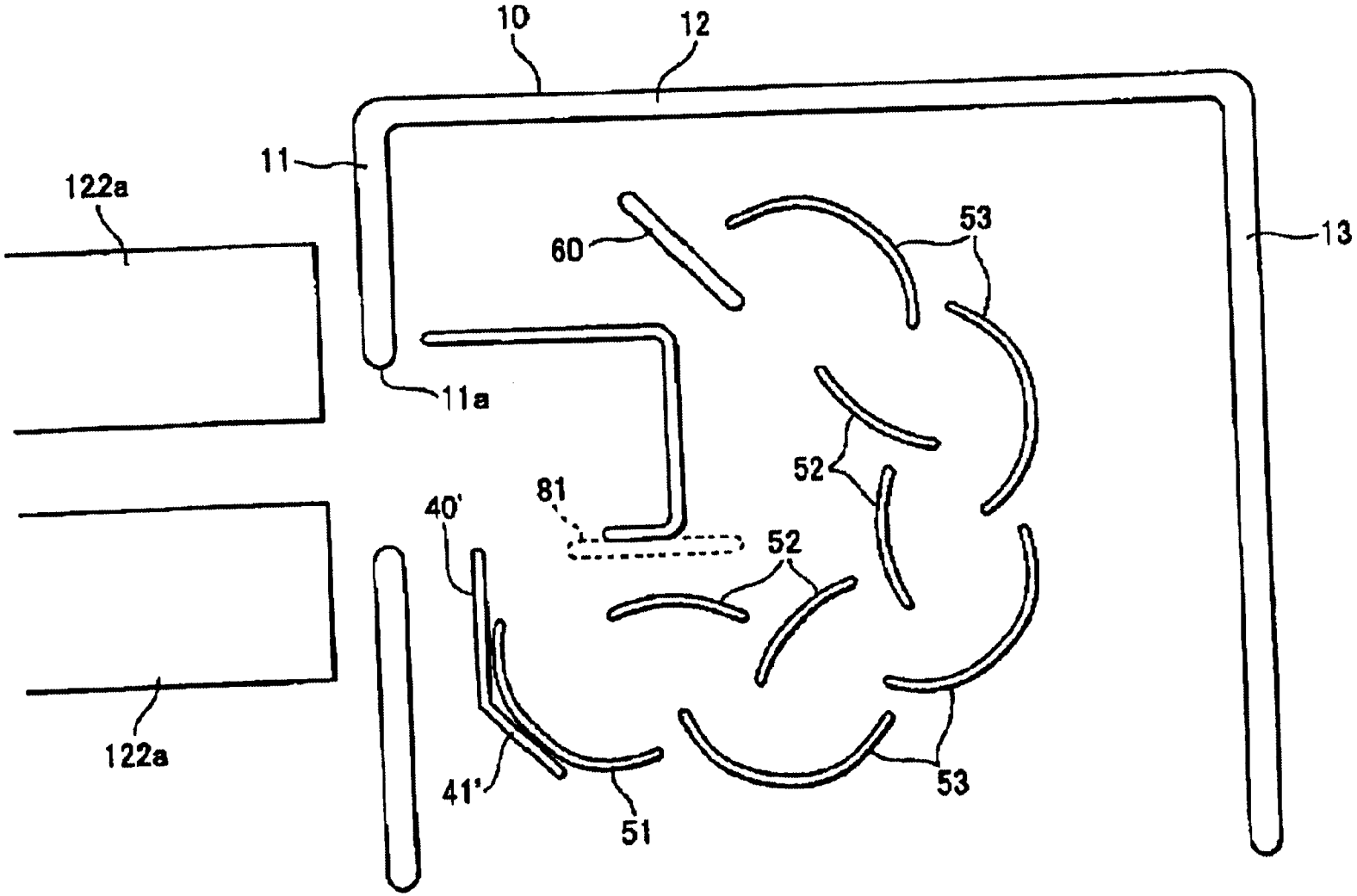
FIG. 8 is a schematic view showing a modification of the embodiment of FIG. 4.

FIG. 8 shows an ion detector according to a modification of the embodiment. In this modification, the deflection electrode 40 is replaced with a deflection electrode 40'. The deflection electrode 40' includes an extension 41' that is welded directly to the ion-to-electron conversion dynode 51. With this configuration, production of the ion detector is much easier.

While the invention has been described in detail with reference to specific embodiments thereof, it would be apparent to those skilled in the art that various changes and modifications may be made therein without departing from the spirit of the invention, the scope of which is defined by the attached claims.

For example, the embodiment described the electrode and the first dynode are connected to the same power source However, an independent voltage source could be used instead.

Further, the operation of switching from the electron multiplier mode to the Faraday cup mode could be performed using a physical switch instead of switching by processes of the data processing unit 130.

What is claimed is:

1. An ion detector comprising:

an ion input face formed with an ion input opening;

a Faraday cup having an ion collection surface that confronts the ion input opening;

an ion-to-electron converter dynode disposed to one side with respect to the Faraday cup and the ion input opening, the ion-to-electron converter dynode having a conversion surface that converts impinging ions into electrons;

two ion deflection electrodes that generate an electron lens that attracts and focuses ions from the ion input opening toward the conversion surface of the ion-to-electron converter dynode;

an electron multiplier portion that receives and multiplies the electrons from the ion-to-electron converter dynode, the electron multiplier portion including a plurality of dynodes that multiply electrons one after the other, the plurality of dynodes being juxtaposed in an arc-shape around the Faraday cup; and an anode that receives electrons from the electron multiplier portion and that outputs a signal that corresponds to the amount of input ions.

2. An ion detector as claimed in claim 1, wherein one of the two ion deflection electrodes is an integral portion of the Faraday cup.

3. An ion detector as claimed in claim 2, wherein the other of the two ion deflection electrodes is electrically connected to the ion-to-electron converter dynode.

4. An ion detector as claimed in claim 1, wherein the plurality of dynodes include inner-side dynodes and outer-side dynodes, the outer-side dynodes being juxtaposed on an imaginary arc farther from the Faraday cup than the inner-side dynodes and each having a larger electron multiplier surface than each of the inner-side dypodes.

5. An ion detector as claimed in claim 1, wherein one of the ion deflection electrodes is electrically connected to the ion-to-electron converter dynode.

6. An ion detector as claimed in claim 1, further comprising:

a supporting substrate that has electrically insulating properties, the electron multiplier portion, the Faraday cup, and the ion deflection electrodes being fixed to the supporting substrate; and a circuit pattern for determining voltage applied to the plurality of dynodes, the circuit pattern being formed on the supporting substrate.

7. An ion detector as claimed in claim 1, further comprising:

a pair of supporting substrates that have electrically insulating properties and that sandwich and fix therebetween the Faraday cup, the ion-to-electron converter dynode, the two ion deflection electrodes, and the electron multiplier portion; and a shield plate connected to ground and fixed between the pair of supporting substrates at a position closer to the anode than to the ion-to-electron converter dynode and the two ion deflection electrodes.

8. An ion detector as claimed in claim 7, wherein the ion input portion and the shield plate are integrally formed.

9. An ion detector as claimed in claim 1, further comprising a supporting substrate that has electrically insulating properties, the electron multiplier portion, the Faraday cup, and the ion deflection electrodes being fixed to the supporting substrate, the supporting substrate being formed with a slit-shaped through hole at a location between the Faraday cup and the first dynode of the electron multiplier portion.

10. An ion detector comprising:

an ion input face formed with an ion input opening;

a Faraday cup having an ion collection surface that confronts the ion input opening, the Faraday cup being connected to ground;

an ion-to-electron converter dynode disposed to one side with respect to the Faraday cup and the ion input opening, the ion-to-electron converter dynode being applied with a high voltage and having a conversion surface that converts impinging ions into electrons;

an ion deflection electrode generating with the Faraday cup and the ion-to-electron converter dynode an electron lens that attracts and focuses ions from the ion input opening toward the conversion surface of the ion-to-electron converter dynode;

an electron multiplier portion that receives and multiplies the electrons from the ion-to-electron converter dynode, the electron multiplier portion including a plurality of dynodes that multiply electrons one after the other, the plurality of dynodes being juxtaposed in an arc-shape around the Faraday cup; and an anode that receives electrons from the electron multiplier portion and that outputs a signal that corresponds to the amount of input ions.

11. An ion detector as claimed in claim 10, wherein the ion deflection electrode is electrically connected with the ion-to-electron converter dynode.

12. A mass spectrometer comprising:

an ionization portion that converts molecules of a sample into ions;

a mass separator that separates desired ions from other ions from the ionization portion; and an ion detector including:

an ion input face formed with an ion input opening that confronts the mass separator;

a Faraday cup having an ion collection surface that confronts the mass separator through the ion input opening;

an ion-to-electron converter dynode disposed to one side with respect to the Faraday cup and the ion input opening, the ion-to-electron converter dynode having a conversion surface that converts impinging ions into electrons;

two ion deflection electrodes that generate an electron lens that attracts and focuses ions from the ion input opening toward the conversion surface of the ion-to-electron converter dynode;

an electron multiplier portion that receives and multiplies the electrons from the ion-to-electron converter dynode, the electron multiplier portion including a plurality of dynodes that multiply electrons one after the other, the plurality of dynodes being juxtaposed in an arc-shape around the Faraday cup; and an anode that receives electrons from the electron multiplier portion and that outputs a signal that corresponds to the amount of input ions.

13. A mass spectrometer as claimed in claim 12, wherein one of the two ion deflection electrodes is an integral portion of the Faraday cup.

14. A quadrupole mass spectrometer as claimed in claim 13, wherein the other of the two ion deflection electrodes is electrically connected to the ion-to-electron converter dynode.

* * * * *